US005267592A

United States Patent [19]

Kaplan et al.

[11] Patent Number: 5,267,592

[45] Date of Patent: Dec. 7, 1993

[54] ELECTRICAL CONNECTOR FOR NOZZLE

[75] Inventors: Jeffrey I. Kaplan, Wilton; James H. Pyle, Weston; Geoffrey F. Wilcox, Roxbury, all of Conn.

[73] Assignee: Saber Equipment Corporation, Stratford, Conn.

[21] Appl. No.: 986,095

[22] Filed: Dec. 4, 1992

[51] Int. Cl.[5] ..... B65B 1/04; B65B 3/00; B67C 3/00

[52] U.S. Cl. ..... 141/387; 141/392; 364/509

[58] Field of Search ..... 141/98, 198, 206, 387, 141/392, 206-212; 364/509, 510; 222/71, 74; 439/284, 251, 840, 191, 192, 194, 289; 128/201.19, 202.13, 202.23, 202.27, 908, 912

[56] References Cited

U.S. PATENT DOCUMENTS

| | | | |
|---|---|---|---|
| 3,470,521 | 9/1969 | Downey | 439/192 |
| 3,771,110 | 11/1973 | Reed | 439/289 |
| 3,980,112 | 9/1976 | Basham | 141/392 |
| 4,005,412 | 1/1977 | Leander | 340/380 |
| 4,140,013 | 2/1979 | Hunger | 73/229 |
| 5,184,309 | 2/1993 | Simpson et al. | 141/392 |

FOREIGN PATENT DOCUMENTS

| | | | |
|---|---|---|---|
| 3438939 | 5/1986 | Fed. Rep. of Germany | 141/392 |
| 2174363A | 11/1986 | United Kingdom . | |

*Primary Examiner*—Henry J. Recla
*Assistant Examiner*—Steven O. Douglas
*Attorney, Agent, or Firm*—Gottlieb, Rackman & Reisman

[57] ABSTRACT

An improved technique for providing electrical power to a fuel dispensing nozzle is disclosed. A plurality of conductive bands are installed around a cylindrical member, and conductive plungers and the fuel dispensing nozzle make contact with the conductive bands. As the fuel dispensing hose is twisted with respect to the nozzle, the conductive bands rotate but nonetheless remain in contact with the conductive plungers, thereby providing uninterrupted power to any desired electronics installed within the fuel dispensing nozzle.

13 Claims, 5 Drawing Sheets

ELECTRICAL CONNECTOR FOR NOZZLE

TECHNICAL FIELD

The present invention relates to fuel dispensing nozzles, and more particularly to an improved technique for supplying electrical power to a fuel dispensing nozzle.

DESCRIPTION OF THE PRIOR ART

In the past several years, workers in the art of fuel dispensing nozzles have attempted to provide electronics, led displays, and basic computer capabilities within the nozzle itself.

U.S. Pat. No. 4,005,412, issued to Leander, on Jun. 25, 1977, is an example of such a system. In the Leander arrangement, a display is placed atop a nozzle. The display is capable of displaying the amount of fuel measured, or other user information. The nozzle is powered by a battery installed therein.

Another example of such a nozzle is described in U.S. Pat. No. 4,140,013, issued to Hunger. In the Hunger patent, the nozzle has an electronic flowmeter, in addition to a display system for displaying data to be read by the user. This patent speaks only generally of power requirements, and suggests using a battery.

Numerous other attempts have been made in the prior art to provide electronics and computer capabilities to a dispensing nozzle. The problem in the prior art is that no safe and efficient way to provide power to the fuel dispensing nozzle exists. Because of the high volatility of fuel being dispensed, it has always been unsafe to provide power supplies in the nozzle, or to run electrical wires to the nozzle. As a result, although numerous patents and prior art publications showing electronics installed into fuel dispensing nozzles exist, none of these have met with commercial success. Regulatory bodies responsible for safety, such as Underwriters Laboratories (UL), have been reluctant to grant approval to fuel dispensing nozzles with unsafe power supplies built in.

Another problem with powering fuel dispensing nozzles is that if the power supply is not built into the nozzle, it must be remotely located and wires run from the remote location, down the fuel dispensing hose, to the nozzle. The problem with this is that the nozzle is often twisted and turned by the user relative to the fuel dispensing hose. Such use presents the danger that the wires will bend too often and eventually fray or electrically short to one another. Due to the volatility of the fuel being dispensed, the situation can become dangerous and explosions may occur.

In view of the desirability of providing user friendly electronics, data input capabilities, and other user friendly items which require electric power in a fuel dispensing nozzle, it can be appreciated from the above discussion that it would be desirable to provide a safe, efficient, and easy to manufacture technique for providing electric power to a fuel dispensing nozzle.

SUMMARY OF THE INVENTION

The above and other problems of the prior art are overcome in accordance with the present invention which relates to an improved technique for providing power to a fuel dispensing nozzle. In accordance with the invention, wires are run down a fuel dispensing hose into a cylindrical member attached to the end of the fuel dispensing hose. A connecting collar screws onto the nozzle and connects the nozzle and hose. The cylindrical member contains a plurality of conductive bands therearound.

When the cylindrical member is connected to the fuel dispensing nozzle, the conductive bands are placed in contact with conductive plungers on the inside of the fuel dispensing nozzle.

The conductive plungers are resilient and tend to expand out and away from the fuel dispensing nozzle. Due to the resiliency of the conductive plungers, the conductive plungers and conductive bands remain in contact with each other despite variations in the surface or the conductive bands and cylindrical member.

Importantly, the fuel dispensing nozzle can rotate freely without effecting the connection between the conductive bands and the conductive plungers. Thus, the problem with the wires twisting is eliminated.

The conductive plungers are connected through the valve of the fuel dispensing nozzle, to the display system, computer electronics, or other electrical device in the fuel dispensing nozzle. Importantly, the risk of tangled and twisted wires is eliminated as is the need for a power supply in the fuel dispensing nozzle itself. Both of these advantages result in a much safer system which can be exploited commercially, unlike all prior art systems.

DETAILED DESCRIPTION OF THE PREFERRED EMBODIMENT

Figures 1, 7, 8:
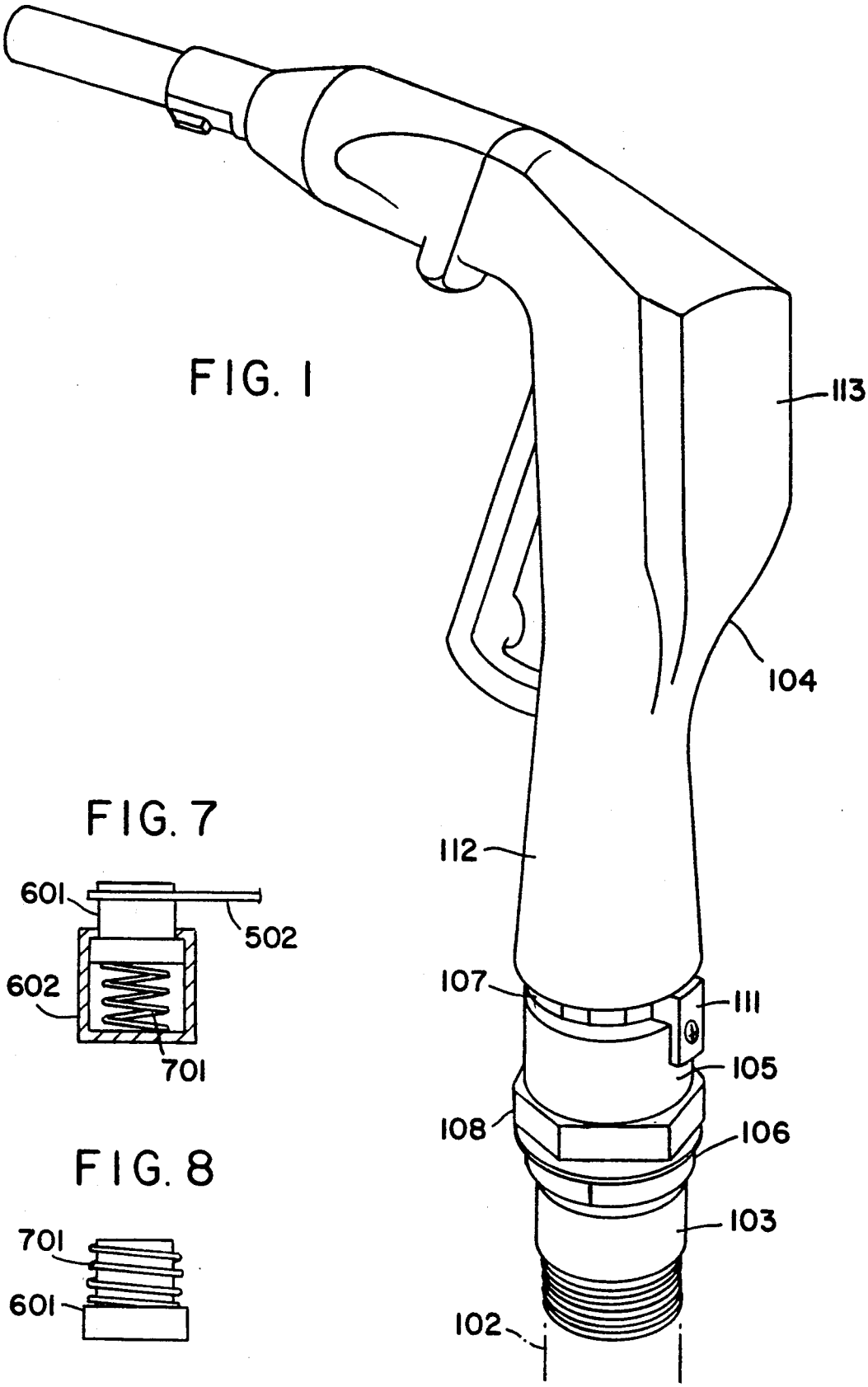
FIG. 1 is a perspective view of a fuel dispensing nozzle with a fuel dispensing hose connected thereto.
FIG. 7 is an enlarged view of the conductive plunger shown in FIG. 5.
FIG. 8 shows an alternative embodiment of the conductive plunger.

FIG. 1 is a perspective view showing a fuel dispensing hose 102 partially connected to fuel dispensing nozzle 104. The nozzle includes a fuel dispensing valve 105 installed therein. Valve 105 is generally cylindrical and is contained within nozzle body 112. The valve is slidably disengageable from nozzle 104 and is preferably held within nozzle 104 by a breakaway ring 107 as described in the previous application Ser. No. 07/931,696 assigned to the same assignee as the present application.

The nozzle body 112 includes optional electronics 113 mounted therein. The electrical connector 111 carries electrical power and/or data signals from valve 105 to nozzle 104 as described hereafter. A valve connector portion 108 of valve 105 mates with a connecting collar 106 of hose 102 to connect dispensing hose 102 to nozzle 104. The fuel dispensing hose 102 includes a plastic hose guard 103 at the point where connecting collar 106 meets with valve connector portion 108. The trigger, spout, and other conventional elements of the nozzle 104 are also shown.

Figure 2:
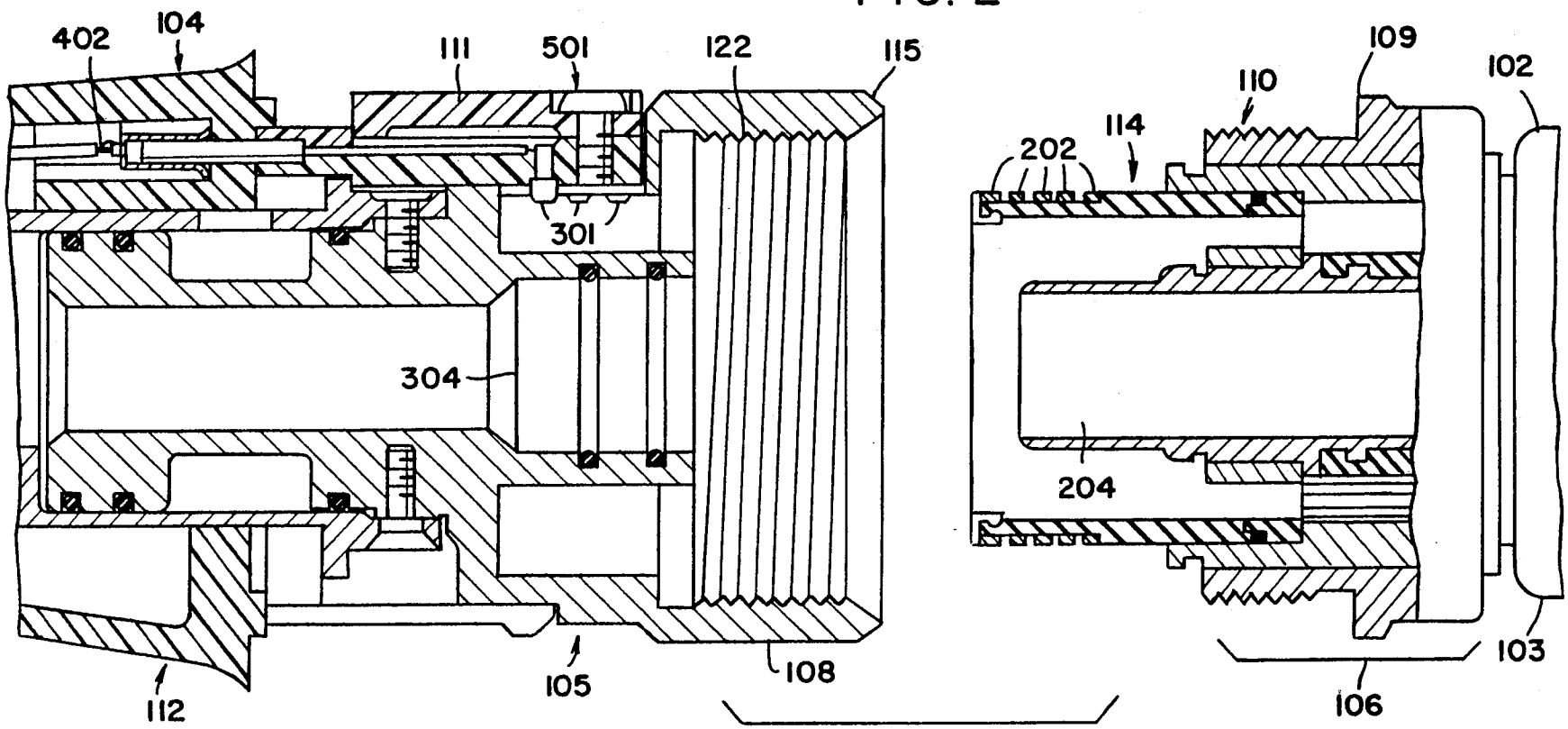
FIG. 2 is an enlarged view of the fuel dispensing hose and nozzle of FIG. 1, showing the portion of the fuel dispensing hose which connects to the fuel dispensing nozzle.

FIG. 2 is a cross-sectional view of the nozzle 104 and hose 102, slightly disconnected from each other. Connecting collar 106 includes a threaded portion 110 which, in actual operation, is fully secured to valve connector portion 108 so that flange 109 butts directly up against valve end 115. Mating threads 122 on the inside of valve connector portion 108 connect directly to threaded portion 110.

Electrical connector 111, more fully described later herein, couples electrical conductors from valve 105 to nozzle body 112. Further electrical conductors 120 may be utilized to run electrical power from the electrical connector 111, through nozzle 104, to electronics 113 which may comprise a display, a data input keypad, or other such device. Additionally, valve control, sensors, and any other electronic or electromechanical devices present in the nozzle may be powered via these electrical conductors. The electronics may, of course, be located anywhere on the nozzle which is convenient or desirable.

The dispensing hose 102 preferably comprises two concentric channels, with inner channel 204 mating with valve channel 304 when the hose and nozzle are connected.

Importantly, connecting collar 106, including threaded portion 110, is free to rotate without rotation of dispensing hose 102, hose guard 103, or cylindrical member 114. The hose can be viewed as comprising two parts. The first is connecting collar 106, and the second piece is comprised of cylindrical member 114, hose 102 and hose guard 103.

If one were to grasp connecting collar 106 to prevent said collar from rotating, and simultaneously rotate fuel dispensing hose 102 about its longitudinal axis, such action would cause hose guard 103 and cylindrical member 114 to rotate as well. All would rotate relative to connecting collar 106, which would remain stationary. This construction keeps the connecting collar 106 from unscrewing as the hose 102 twists and turns.

Figure 3:
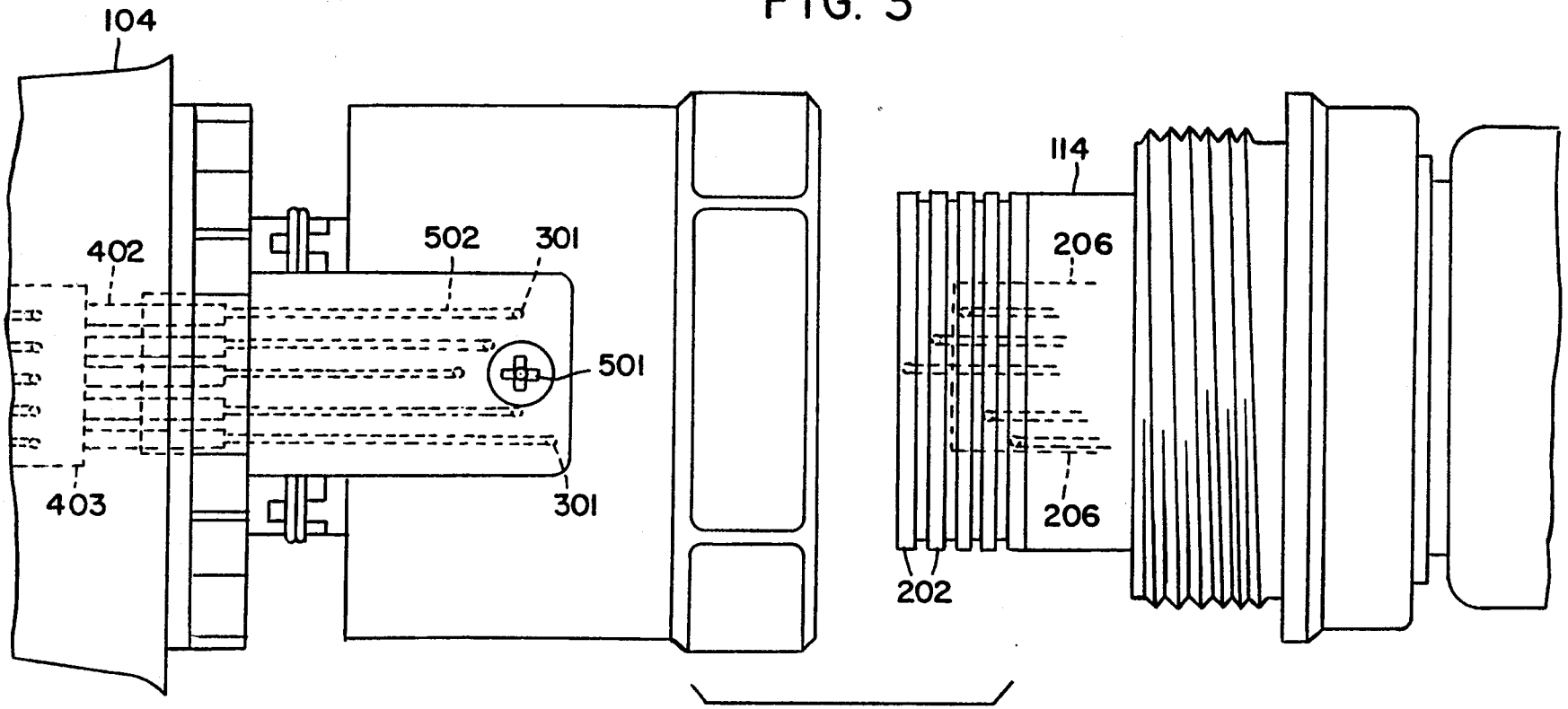
FIG. 3 is a top exploded view of the fuel dispensing nozzle and hose.

FIG. 3 shows a top view of the hose and nozzle disconnected from one another as in FIG. 2. FIGS. 2 and 3 show that cylindrical member 114 also includes a plurality of conductive bands 202 preferably made from copper. The conductive bands run circumferentially around the outside of cylindrical member 114. It is understood that while in this exemplary embodiment conductive bands 202 span the entire outer perimeter of cylindrical member 114, this need not be the case. For example, if rotation of the nozzle 104 relative to hose 102 is limited to less than 360°, then there will be portions of the cylindrical member 114 to which the conductive bands need not be affixed. This is simply a matter of design choice. For example, one way of preventing rotation is to change cylindrical member 114 so that it is not completely cylindrical.

The conductive bands 202 are parallel to one another and each is capable of conducting electricity of sufficient quantity to exchange signals and power with the desired electronics installed in the fuel dispensing nozzle.

Shown in dotted outline in FIG. 3 are conductors 206. Conductors 206 run down the length of fuel dispensing hose 102 from a power supply installed in a remote location. The plurality of conductors 206 are preferably color coded and each terminates inside cylindrical member 114. The power supply should be of an intrinsically safe design and approved for use in a fuel dispensing environment. Techniques for designing such supplies and/or adopting conventional supplies for intrinsic safety are well known in the art.

Each of the conductors 206 is connected to a different one of conductive bands 202 as depicted in FIG. 3. The conductors 206 terminate inside the cylindrical member 114 and a separate small bore 306 is drilled through cylindrical member 114 to connect each conductor 206 from the inside of cylindrical member 114 to its associated conductive band on the outside of cylindrical member 114. The connection is preferably made by including a small conductive stub on the inside of each conductive band 202 which protrudes through the small bore on cylindrical member 114 into the inside of cylindrical member 114.

Figure 4:
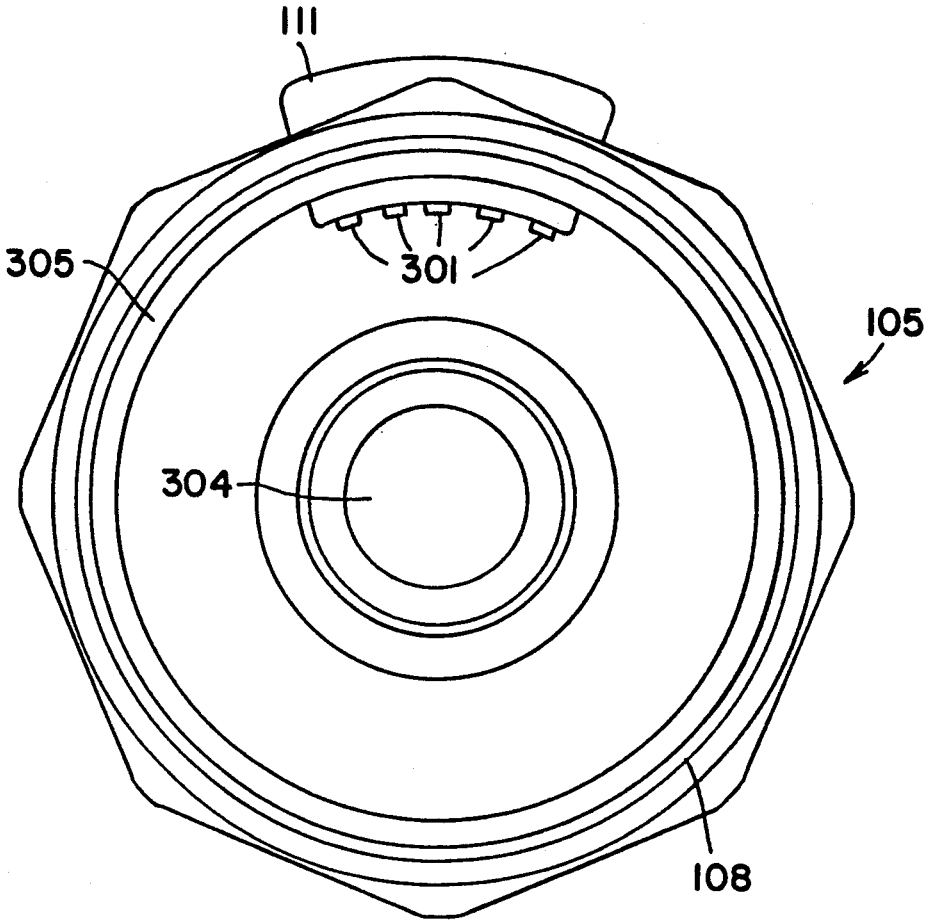
FIG. 4 is a rear view of the fuel dispensing nozzle.

FIG. 4 depicts a rear view of valve 105 looking into the valve with dispensing hose 102 fully removed. Electrical connector 111 is also shown in FIG. 4. Inner valve channel 304 mates with channel 204 from dispensing hose 102. Cylindrical member 114, with its previously described conductive bands 202, would lie between valve channel 304 and the outer surface 305 of valve connector portion 108.

A plurality of conductive plungers 301 emanate from electrical connector 111 as best seen in FIGS. 2 and 3. The particulars of these conductive plungers will be described later herein. The conductive plungers are arranged so that each of them contacts a different one of the conductive bands 202 when the dispensing hose is mated with the fuel dispensing nozzle. The conductive plungers are arranged along electrical connector 111 around screw 501 as best seen in FIG. 3.

Figure 6:
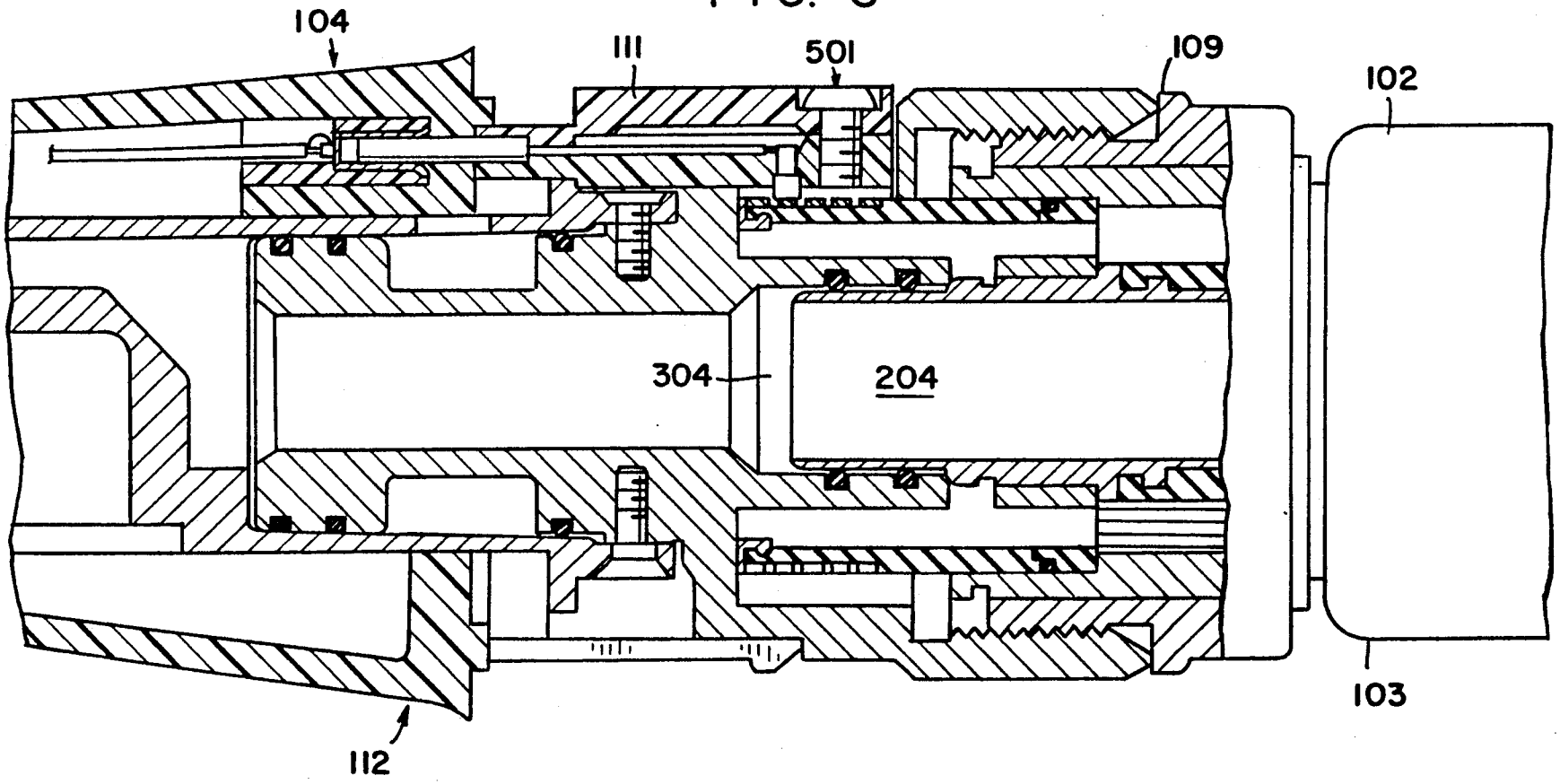
FIG. 6 is a cross-sectional exploded view of the nozzle connected to the hose.

It can be seen from FIGS. 3 and 6 that when the dispensing hose 102 is fully inserted into valve connector portion 108, the electricity and/or electrical signals will be supplied from conductors 206 through conductive bands 202, to conductive plungers 301, and through electrical connector 111 to the dispensing nozzle. The signals may then be transmitted through the dispensing nozzle to the appropriate electronics by a set of conductors 120 installed within the dispensing nozzle.

In the preferred embodiment, electrical connector 111 includes a plurality of stubs 402 which mate with a plurality of sockets 403 in a different connector in dispensing nozzle 104 as shown in FIG. 3. However, it should be noted that once the appropriate power and electrical signals are supplied through electrical connector 111 to dispensing nozzle 104, any appropriate technique can be utilized to run the power and signals to and from the appropriate electronics in the dispensing nozzle 104.

Figure 5:
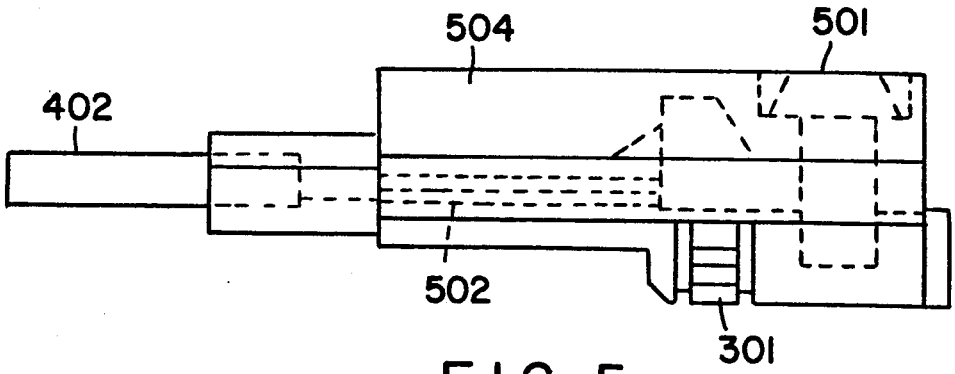
FIG. 5 is an enlarged view of the electrical connector shown in FIG. 4.

An exploded view of electrical connector 111 is shown in FIG. 5. One of stubs 402 is shown as extruding from the connector. As described with reference to the previous figures, these stubs would mate with a socket for supplying power and/or signals to the dispensing nozzle. Stubs 402 are connected to conductive plungers 301 through the connector by means of conductors 502.

The connector 111 is preferably manufactured in two parts with a small screw 501 holding the parts together. This allows the conductive plungers 301, one of which is shown by means of a cutaway in FIG. 5, to be placed in the bottom portion 503 and connected to their respective conductors 502 before the top portion 504 is connected thereto.

The conductive plungers 301 are slightly compressible in length so that as cylindrical member 114 rotates, small variations in the width of conductive bands 202 or cylindrical member 114 itself are compensated for. Moreover, the plungers 301 are spring loaded and thus resiliently tend to expand to their full length. Therefore, contact with conductive bands 202, as shown in FIG. 6, is maintained despite variations in the thickness of the conductive bands, the shape of cylindrical member 114, etc.

An exploded view of a conductive plunger 301 is shown in FIG. 7. An exemplary conductor 502 provides the signal to an upper member 601 which is slidably engaged into a lower member 602. A spring 701 tends to expand the plunger. When the conductive plunger is installed in electrical connector 111, the lower member 602 cannot fit completely out the bottom portion of lower portion 503 of electrical connector 111. Upper member 601 cannot move upward at all since upper portion 504 of electrical connector 111 prevents such movement. Therefore, when the conductive plunger 301 of FIG. 7 is installed properly into an electrical connector 111, it tends to expand, but it cannot fully separate. As cylindrical member 114 rotates, conductive bands 202 press up against conductive plunger 301 and conductive plunger 301 constantly remains in contact with the conductive bands 202. Thus, there is no interruption of power or signals.

FIG. 8 shows an alternative implementation of conductive plunger 301. In the embodiment of FIG. 8, only a single member 601 is utilized, and a spring 701 is utilized in order to force the member outward. The spring pushes against the electrical connector 111 and tends to bias the member 601 and keep it in contact with the conductive bands. The embodiment of FIG. 8 is presently believed to be easier to manufacture.

Returning to FIG. 2, in operation, the dispensing hose 102 is connected to the dispensing nozzle 104 by turning connecting collar 106 clockwise, thereby screwing threaded portion 110 into valve connector portion 108. The inside of valve connector 108 includes the appropriate mating threads 122. When the connecting collar 106 is fully tightened, the arrangement appears as in FIG. 6, with flange 109 touching valve end 115 and each of conductive bands 202 in contact with its associated conductive plunger 301 for purposes of clarity, only one conductive plunger 301 is shown in FIG. 6.

During use, dispensing hose 102 will be twisted and turned by service station attendants or self service users. Such turning will cause cylindrical member 114 to turn but will not cause connecting collar 106 to turn. Therefore, the collar will not be unscrewed. However, as cylindrical member 114 turns the electricity will not be interrupted nor will any wires be twisted because conductive bands 202 span the circumference of cylindrical member of 114 therefore, the conductive bands 202 will remain in contact with their respective conductive plungers 301 as cylindrical member 114 turns.

The above describes the preferred embodiments of the present invention. However, it will be understood that various modifications and/or additions will be apparent to those of ordinary skill in the field. For example, the particular types of electrical connectors or conductors used, and particular channels utilized in order to dispense the fuel, are not critical to the present invention. Nor is the particular nozzle. The conductive plungers may be placed on the inside or outside of the valve connecting portion, or may even be placed elsewhere on the dispensing nozzle if convenient.

Other types of valves and dispensing arrangements may be utilized without the departing from the spirit and scope of the present invention.

We claim:

1. A fuel dispensing apparatus comprising:

a nozzle, said nozzle including;

a valve housing a valve coupling portion for connecting to a fuel dispensing hose;

one conductive plunger disposed on the valve coupling portion and resiliently tending to expand away from said valve coupling portion such that it remains in contact with a conductive band placed against said conductive plunger despite variations in the surface of said conductive band.

2. A fuel dispensing apparatus comprising a nozzle according to claim 1, said apparatus further comprising:

a fuel dispensing hose, said fuel dispensing hose comprising:

a member for mating with said valve coupling portion;

at least one conductive band, each of said conductive bands being affixed to the outer perimeter of said member; and a connecting collar attaching the fuel dispensing hose to the valve coupling portion, thereby placing said conductive bands in contact with said at least one conductive plunger.

3. The fuel dispensing apparatus of claim 2, wherein said conductive bands span the entire outer perimeter of said member.

4. The fuel dispensing apparatus of claim 3, wherein said member is cylindrical.

5. The fuel dispensing nozzle of claim 5 wherein said electrical connector comprises a plurality of stubs thereon for connecting to conductors within the fuel dispensing nozzle.

6. The fuel dispensing apparatus of claim 4 further comprising an electrical connector for mounting said conductive plungers, said electrical connector further comprising a separate conductor connected to each of said conductive plungers and routing an electrical signal from said conductive plunger, through said connector and into said fuel dispensing nozzle.

7. The fuel dispensing apparatus of claim 4 wherein said fuel dispensing hose comprises an inner channel and an outer channel.

8. The fuel dispensing apparatus of claim 4 wherein said fuel dispensing nozzle comprises:

an electronic display for displaying data.

9. The fuel dispensing arrangement according to claim 7 further comprising data input means attached to said fuel dispensing nozzle for allowing a user to enter digital data.

10. The fuel dispensing nozzle of claim 4 wherein said at least one conductive plunger comprises a lower member;

an upper member slidably engaged within said lower member; and means for biasing said upper and lower members away from one another such that said conductive plunger tends to expand to its maximum length.

11. A fuel dispensing apparatus comprising:

a cylindrical dispensing hose, said hose including a plurality of conductive bands therearound;

a dispensing nozzle, said nozzle including a valve connecting portion for coupling to said dispensing hose;

a plurality of conductive plungers inside said valve connecting portion and disposed such that when said dispensing hose is fully connected to said dispensing nozzle, said conductive plungers are in contact with said conductive bands.

12. The fuel dispensing apparatus of claim 11 wherein said fuel dispensing hose includes a connecting collar, said connecting collar including a plurality of threads thereon and being freely rotatable about the longitudinal axis of said dispensing hose.

13. Apparatus of claim 12 wherein said fuel dispensing hose and said nozzle each comprise an inner and outer channel.

* * * * *

UNITED STATES PATENT AND TRADEMARK OFFICE

CERTIFICATE OF CORRECTION

PATENT NO. : 5,267,592

DATED : December 7, 1993

INVENTOR(S) : Kaplan, et. al.

It is certified that error appears in the above-indentified patent and that said Letters Patent is hereby corrected as shown below:

On the Title page, item [75], inventor: Jeffrey I. Kaplan, Wilton" to --W. Dwain Simpson, Wilton--.

Signed and Sealed this

Seventeenth Day of May, 1994

Bruce Lehman

*Attest:*

BRUCE LEHMAN

*Attesting Officer*

*Commissioner of Patents and Trademarks*